United States Patent [19]

Jordan

[11] 3,986,633

[45] Oct. 19, 1976

[54] TAB FOR EASY-OPENING CONTAINER WALL

[75] Inventor: Charles L. Jordan, Pittsburgh, Pa.

[73] Assignee: Aluminum Company of America, Pittsburgh, Pa.

[22] Filed: Jan. 22, 1976

[21] Appl. No.: 651,561

[52] U.S. Cl. ..... 220/273

[51] Int. Cl.[2] ..... B65D 41/32

[58] Field of Search ..... 220/270, 273

[56] References Cited

UNITED STATES PATENTS

| | | | |
|---|---|---|---|
| 3,773,210 | 11/1973 | Radtke | 220/273 |
| 3,780,902 | 12/1973 | Holc et al. | 220/273 |
| 3,863,801 | 2/1975 | Pillnik | 220/270 X |

*Primary Examiner*—George T. Hall

*Attorney, Agent, or Firm*—Andrew Alexander

[57] ABSTRACT

A pull tab comprises a tab body, a tang and a portion connecting the tang to the tab body. In the pull tab, which is attachable to an easy-open end container wall, the tang projects from the tab body such that upon attaching the tang to the container wall, the tang holds the pull tab against a central portion of the container wall to prevent excessive lifting of the tab body therefrom when the central portion is outwardly domed as a result of pressure in the container.

5 Claims, 6 Drawing Figures

TAB FOR EASY-OPENING CONTAINER WALL

BACKGROUND OF THE INVENTION

This invention relates to an easy-opening end container wall and more particularly, to an improved pull tab of the type attachable to a removable section in the container wall.

There are several general types of easy-opening end closures for containers all of which use pull tabs to initiate severance of a removable portion therefrom. In one type of closure, a relatively small tear-out section is removed to permit pouring of liquid contents, such as beverages, from the container. In another type, a central panel, comprising most of the easy-opening end closure, is removed to permit removal of solid and semi-solid type contents, such as processed foods. In this latter type of closure, the pull tab is normally positioned with its nose located over or adjacent to a generally circumferential score line and with its lifting portion projecting inwardly towards the center of the closure. This type of pull tab arrangement can cause problems by it free end or lifting portion projecting upwardly from the closure during processing steps.

In preparing processed foods, for example, high pressure is experienced within the container as it is subjected to a sterilization treatment subsequent to the canning process. The high pressure tends to cause the central panel of the easy-open end closure to bulge or dome outwardly. This outward doming of the central panel can cause the free end or lifting portion of the pull tab to project upwardly, often beyond the can chime, which may result in accidental opening of the container by the free end catching or snagging and consequently being torn off. Holc et al U.S. Pat. No. 3,780,902 teach that this problem may be solved by providing means in the central panel for releasably holding the opening tab substantially flat against the central panel when the central panel bulges outwardly due to internal pressure of the container. However, this solution requires additional forming in the central panel to provide protuberances which releasably engage the pull ring of the opening tab.

An improved pull tab is provided in which, without requiring additional forming in the central panel, the lifting portion of pull ring thereof will remain substantially flat against the central panel even though the panel is domed due to internal pressure.

SUMMARY OF THE INVENTION

A principal object of this invention is to provide an improved pull tab for an easy-opening end closure.

Another object of this invention is to provide an improved pull tab for an easy-opening end container, wherein the tab body is held under pressure against the easy-opening end even after the end is domed as a result of internal pressure of the container.

Yet another object of this invention is to provide an improved pull tab which can be used with conventional easy-opening ends.

These and other objects will become apparent from the description, drawings and claims appended hereto.

In accordnce with these objects, there is provided a tab of the type attachable to an easy-open end closure to initiate severance of a segment from a central portion in the closure. Closures of the type referred to are particularly suitable for containers which are subjected to internal pressure. The pull tab comprises a tab body and projecting tang made from sheet material, the tang having a portion thereof adapted to be attached to the easy-opening closure as by an integral rivet, for example. In addition, the tab body, formed from sheet material, has a generally ring-like configuration which circumscribes the tang and is joined to it by a connecting portion which projects generally downwardly from the tab body to the tang. The tab body has a lifting side substantially opposite the connecting portion, which lifting side, upon attaching the tang to the easy-open end closure, is held under spring pressure against the end closure thus preventing excessive lifting of the tab body from the central portion when it becomes domed as a result of pressure in the container.

DETAILED DESCRIPTION OF THE PREFERRED EMBODIMENT

Figure 1:
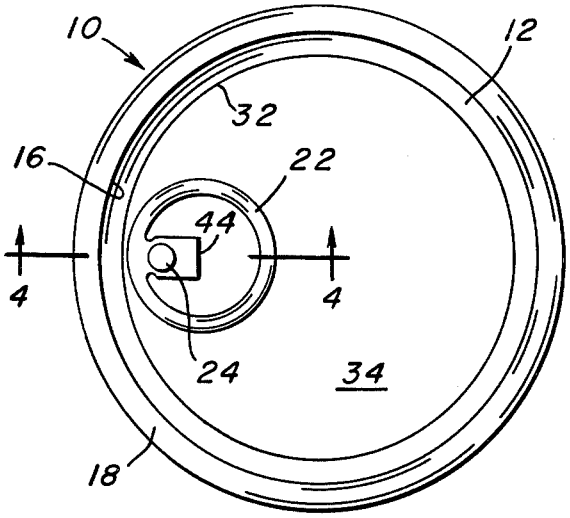
FIG. 1 is a top plan view of a container end closure having an improved pull tab in accordance with this invention.
Figure 4:
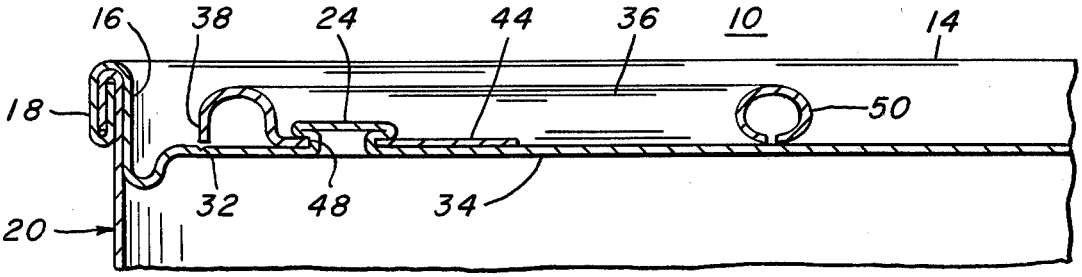
FIG. 4 is a cross-sectional view along the line 4—4 of FIG. 1.
Figure 5:
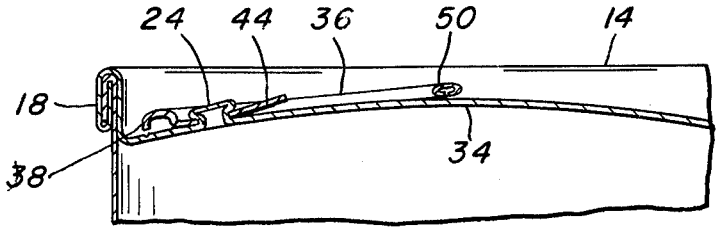
FIG. 5 is a cross-sectional view of a pull tab in accordance with the invention on a container end closure domed as a result of internal pressure.

Referring to FIG. 1, a container wall or can end 10 is shown which includes a generally planar central end wall 12 which has indented in it, at or adjacent its periphery, a score line 32 which defines a removable central panel 34 that in the forms shown includes a major portion of planar central end 12. Additionally, end 10 includes an upstanding chuck wall 16 radially outwardly of score line 32, and a flange 18 extending outwardly from the top of the chuck wall. This type of construction of a peripherally chimed can end is typical of can ends which are adapted to be sealed on container bodies by conventional double seaming operations. Flange 18 which is double seamed on to a container body 20 is shown in FIGS. 4 and 5. A pull tab 22 constructed in accordance with the teachings of this invention is attached to removable central panel 34 by, for example, a hollow rivet 24 formed integrally with removable panel 34.

Figure 2:
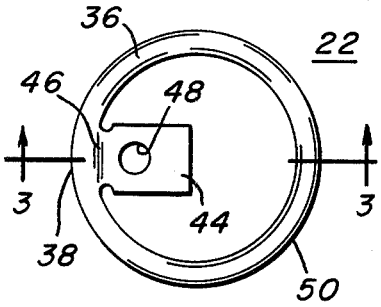
FIG. 2 is an enlarged top plan view of the pull tab shown in FIG. 1.
Figure 3:
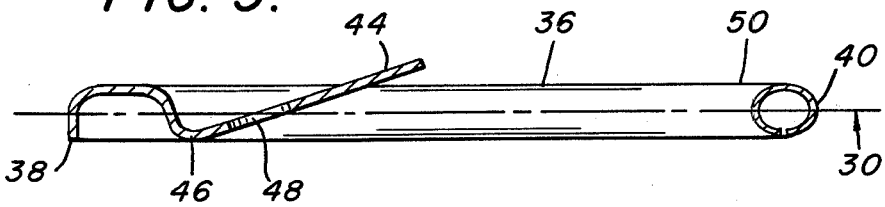
FIG. 3 is a cross-sectional view along the line 3—3 of FIG. 2.

With reference to FIGS. 2 and 3, it will be seen that pull tab 22, which is formed from sheet material such as aluminum sheet, for exmple, has a generally ring-like tab body 36 which provides a finger-receiving opening and projects rearwardly from a nose or forward section 38. By reference to FIG. 3 it will be seen that the sheet material of tab 22 is turned or curled downwardly and inwardly to form a bead 40 which preferably extends substantially continuously around tab body 36. Bead 40 as well as reinforcing the tab provides a smooth surface for engagement by the finger and further provides a lifting portion 50.

By reference to FIGS. 3 or 4 it will be observed that pull tab 22 has a generally planar configuration for purposes of illustration. However, the present invention contemplates pull tabs with raised portions thereon which, for example, provide ease of access for initial lifting of the tab body.

By reference to FIG. 2, it will be seen that tab 36 has a tang 44 substantially circumscribed by ring-like body 36. Also, in FIG. 2, it will be seen that the tang has an aperture 48 therein for receiving hollow rivet 24 to attach pull tab 22 to removable central panel 34. By further reference to FIG. 2, tang 44 projects generally radially from tab body 36 substantially opposite nose or forward section 38 towards lifting portion 50 and is integrally connected to tab body 36 by a connecting portion 46. In FIG. 3, it will be noted that tab body 36 is generally planar and dotted line 30 is shown therein to provide a reference plane. In accordance with the teachings of this invention, tang 44, as well as extending rearwardly toward lifting portion 50, projects out of the generally planar tab body 36 at an angle which normally should not be less than 10° as measured against the reference plane. Preferably, tang 44 projects upwardly out of the tab body, and further preferably, the angle should be at least equal to the maximum angle assumed by the central panel when it is domed due to internal pressure which maximum angle should be measured at about the point of attachment of the tang with central panel 34. The angle with which tang 44 projects out of the plane of tab body 36 can be greater than the maximum angle assumed by the domed central panel at the point of the attachment. The maximum angle at which the tang can project upwardly from the plane of the tab body should be an angle which would not interfere with attaching tang 44 to central panel 34. Preferably, the maximum tang angle is not more than 50°. Connecting portion 46 of tang 44 should be sufficiently pliable to permit hinge type movement between the tab body 36 and tang 44.

Figure 6:
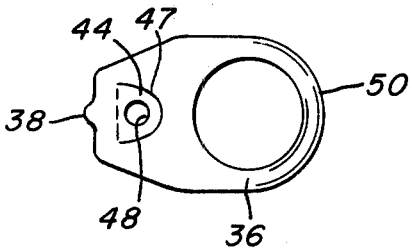
FIG. 6 is a top plan view of an alternate pull tab configuration in accordance with the invention.

An alternate pull tab configuration, contemplated within the preview of the present invention, is shown in FIG. 6. The pull tab comprises a tab body 36, a tang 44 with aperture 48 therein, a nose 38 and a lifting portion 50. In this configuration, tang 44, cut or severed from tab body 36 as defined by lance line 47, projects out of tab body 36 in a manner similar to that just noted and extends away from nose 38 in the general direction of lifting portion 50.

By reference now to FIG. 4, tab body 36 is shown attached by means of hollow rivet 24 through aperture 48 in tang 44 to removable central panel 34. Nose or forward section 38 of tab body 36 is positioned over score line 32 to initiate severance of removable central panel 34 from the remainder of can end 10. In this arrangement, the portion of tab body 36 farthest from nose 38 serves as a lifting portion 50, as noted above, which can be raised to force nose 38 to severe score line 32.

By inspection of FIG. 4, it will be observed that in tab body 36, fastened as just mentioned to central panel 34, tang 44 is forced to lie in generally surface-to-surface adjacency with removable central panel 34 by virtue of the pressure exerted on it by hollow rivet 24. Additionally, tang 44 is forced to lie in a plane substantially parallel with the plane of tab body 36 even though, as noted earlier, tang 44 was formed to project upwardly at an angle not normally less than 10° from the plane of tab body 36 (FIG. 3). As tang 44 is forced to lie generally parallel to central panel 34, it transfers a force by leaf spring action through connecting portion 46 to tab body 36. This force prevents excessive lifting of the tab body, especially at its lifting portion, from the central panel 34 when central panel 34 becomes domed as a result of internal pressure of the container as can best be seen in FIG. 5. It will be noted in FIG. 5 that the lifting portion 50 remains under the upper extremity of chime 14 even though central panel 34 is domed due to internal pressure of the container and thus opening of the container by accidental catching or snagging of the lifting portion is avoided. When central panel 34 returns to its original shape or loses at least part of its domed shape as a result of pressure in the container subsiding, for example, after the sterilization treatment (FIG. 4) tab body 36 will also be forced back to its original position by virtue of the spring pressure transferred by tang 44.

The end or container wall referred to hereinabove includes closures from jars, ends for cans and other types of container walls.

While the invention has been described in terms of preferred embodiments, the claims appended hereto are intended to encompass all embodiments which fall within the spirit of the invention.

Having thus described my invention and certain embodiments thereof, I claim:

1. An improved pull tab of the type attachable to an easy-opening end wall on a container to initiate severance of a segment from said wall, said container of the type subjected to internal pressure, said pull tab comprising:

a tab body formed from sheet material and having a finger receiving opening;

a tang having a portion thereof adapted to be attached to said easy-opening end wall; and a connecting portion connecting said tang to said tab body at one side thereof, said tang projecting out of said tab body such that upon attaching said tang to said easy-opening end wall, said tang holds said tab body under spring pressure against said end wall to prevent excessive lifting of said tab body from said central portion when said central portion is domed as a result of internal pressure in the container.

2. A tab according to claim 1 wherein said tang projects out of said tab body at an angle of at least 10°.

3. A tab according to claim 1 wherein said tang projects out of said tab body at an angle in the range of 10° to 50°.

4. An improved easy-opening closure for a container of the type wherein opening of the closure is initiated by severance of a score line by a pull tab secured to said end closure by means of a hollow rivet integrally formed with said end closure, wherein the improvement comprises a pull tab having:

a tab body formed from sheet material and having a ring-like configuration;

a tang having a portion thereof adapted to be attached to said easy-opening end wall; and a connecting portion connecting said tang to said tab body at one side thereof, said tab body having a lifting portion substantially opposite said tang, said tang formed to project out of said tab body such that upon attaching said tang to said easy-opening end wall, said tang holds said tab body under spring pressure against said end wall to prevent excessive lifting of said tab body from said central portion when said central portion is domed as a result of internal pressure in the container.

5. The pull tab according to claim 4 wherein said tang projects out of said tab body at an angle in the range of 10° to 50°.

* * * * *